US009611726B2

(12) United States Patent
Sangare et al.

(10) Patent No.: US 9,611,726 B2
(45) Date of Patent: Apr. 4, 2017

(54) SHOCK MITIGATOR

(71) Applicant: Schlumberger Technology Corporation, Sugar Land, TX (US)

(72) Inventors: Fahira Sangare, Sugar Land, TX (US); John E. Fuller, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 334 days.

(21) Appl. No.: 14/039,146

(22) Filed: Sep. 27, 2013

(65) Prior Publication Data

US 2015/0090452 A1 Apr. 2, 2015

(51) Int. Cl.
*E21B 43/11* (2006.01)
*E21B 43/119* (2006.01)

(52) U.S. Cl.
CPC ..... *E21B 43/1195* (2013.01)

(58) Field of Classification Search
CPC ... E21B 47/011; E21B 43/116; E21B 43/1195
See application file for complete search history.

(56) References Cited

U.S. PATENT DOCUMENTS 2,266,342 A * 12/1941 Spencer ..... E21B 43/116 175/4.57
2,266,352 A * 12/1941 Zschokke ..... E21B 43/116 175/4.59
2,326,114 A * 8/1943 Zschokke ..... E21B 43/116 175/4.57
3,221,655 A * 12/1965 Venghiattis ..... E21B 43/117 175/4.55
3,327,793 A * 6/1967 Porter ..... E21B 43/116 175/4.55
3,923,106 A 12/1975 Bosse-Platiere
4,286,217 A * 8/1981 Planche ..... G01V 3/20 324/347
4,633,945 A * 1/1987 Upchurch ..... E21B 43/11852 166/55.1
4,706,744 A * 11/1987 Smith ..... E21B 17/023 166/65.1
4,817,718 A * 4/1989 Nelson ..... E21B 34/10 166/297
5,088,557 A 2/1992 Ricles et al.
(Continued)

FOREIGN PATENT DOCUMENTS

WO 2013095947 A1 6/2013

OTHER PUBLICATIONS

"StimGun Technology", Oct. 2000, pp. 1-191.*
(Continued)

*Primary Examiner* — Jennifer H Gay
(74) *Attorney, Agent, or Firm* — Tuesday Kaasch

(57) ABSTRACT

An assembly with a shock inducing tool and shock sensitive components. The assembly includes a shock mitigator that is constructed in a manner that allows a communication line to stretch across an interface of the mitigator between a housing for the components and the shock inducing tool. So, for example, where the tool is a perforating gun, power and/or communication with the tool need not be sacrificed for in exchange for safeguarding electronic components of the housing with the mitigator.

17 Claims, 5 Drawing Sheets

(56) References Cited

U.S. PATENT DOCUMENTS

| | | | | |
|---|---|---|---|---|
| 5,095,993 | A * | 3/1992 | Huber | E21B 17/028 166/217 |
| 5,109,921 | A * | 5/1992 | Aracena | E21B 17/023 166/377 |
| 5,201,814 | A * | 4/1993 | Kitchell | E21B 17/023 166/377 |
| 6,571,046 | B1 * | 5/2003 | Hickey | E21B 17/003 385/134 |
| 6,837,310 | B2 * | 1/2005 | Martin | E21B 43/117 166/250.1 |
| 7,661,366 | B2 | 2/2010 | Fuller et al. | |
| 8,397,800 | B2 * | 3/2013 | Rodgers | E21B 17/07 166/178 |
| 8,397,814 | B2 * | 3/2013 | Rodgers | E21B 17/07 166/297 |
| 8,978,817 | B2 * | 3/2015 | Rodgers | G10K 11/16 181/207 |
| 2002/0148611 | A1 * | 10/2002 | Williger | E21B 43/119 166/297 |
| 2004/0104029 | A1 * | 6/2004 | Martin | E21B 43/117 166/298 |
| 2009/0159283 | A1 | 6/2009 | Fuller et al. | |
| 2010/0147519 | A1 | 6/2010 | Goodman et al. | |
| 2010/0286800 | A1 * | 11/2010 | Lerche | E21B 43/116 700/90 |
| 2011/0017448 | A1 * | 1/2011 | Pipchuk | E21B 19/22 166/250.07 |
| 2011/0042089 | A1 | 2/2011 | Chang et al. | |
| 2011/0150596 | A1 * | 6/2011 | Wolodko | E21B 17/06 411/5 |
| 2012/0255722 | A1 | 10/2012 | Rodgers et al. | |
| 2014/0260591 | A1 * | 9/2014 | Rodgers | G10K 11/16 73/152.58 |
| 2014/0290352 | A1 * | 10/2014 | Walter | E21B 47/011 73/152.58 |
| 2014/0305660 | A1 * | 10/2014 | Ash | F16F 7/12 166/381 |
| 2014/0312752 | A1 * | 10/2014 | Durisotti | E21B 47/011 312/237 |
| 2015/0090452 | A1 * | 4/2015 | Sangare | E21B 43/1195 166/297 |

OTHER PUBLICATIONS

Ager, Scott A, "IES Fast Speed Cauges", Mar. 2, 2009, pp. 1-39.*
IES, "Series 300, High Shock, High Speed Pressure Gauge", Feb. 2010, pp. 1-2.*
Robinson, "Polymer & Material Selection Guide", 2005, pp. 1-10.*
Ager, Scott A., "IES Shock Mitigator," Presentation, Sep. 10, 2008, IES(R), 21 pages.

* cited by examiner

SHOCK MITIGATOR

BACKGROUND

Exploring, drilling and completing hydrocarbon and other wells are generally complicated, time consuming and ultimately very expensive endeavors. As a result, over the years well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbons, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Indeed, a variety of isolating, perforating and stimulating applications may be employed in conjunction with completions operations.

In the case of perforating, different zones of the well may be outfitted with packers and other hardware, in part for sake of zonal isolation. Thus, wireline or other conveyance may be directed to a given zone and a gun assembly with related and/or controlling tools employed to create perforation tunnels through the well casing. As a result, perforations may be formed into the surrounding formation, ultimately enhancing recovery therefrom.

The described manner of perforating can be accompanied by a significant degree of 'gun shock'. That is, as the gun is fired, high frequency vibrations at high g-forces may propagate through the gun and to adjacent tools. Once more, even after the primary event of firing, secondary 'aftershock' may ensue as the gun assembly is thrown about the well, rattling against the casing and any other downhole equipment.

The cumulative effect of this gun shock may be to damage the overall gun assembly beyond repair after only a single use. For example, electronics of assembly tools are likely to suffer solder joint and circuitry damage through both the initial wave of shock and subsequent downhole aftershock. With this in mind, the gun is often limited in terms of length and diameter so as to minimize the amount of shock damage to the overall assembly. Specifically, reusable perforating guns are generally limited to under about 2½ inches in diameter with a range or length spanning well under 20 or so perforating ports. These limitations constrain the total amount of explosive energy that the gun utilizes during any given perforating application. Thus, gun assembly damage attributable to gun shock may be kept to a minimum.

Of course, placing constraints on the gun as noted above also limits operator application options when utilizing the gun assembly. That is, it stands to reason that keeping the gun at or below 2½ inches in diameter in order to effectively limit the amount of gun shock also limits the perforating application itself. So, for example, an operator may seek a variety of application options in order to enhance perforation depth, profile or other characteristics. However, to the extent that these options would require a larger amount of explosive or different shaped charge profile than may be accommodated by a 2½ inch diameter gun, such options would be unavailable.

Compounding matters is the fact that the described constraints are not full proof. That is, placing such dimensional limitations on the gun is directed at preventing damage to adjacent gun assembly tools, thereby allowing the gun to be continually reused. However, the overall assembly continues to suffer some degree of shock related damage over time, regardless of these dimensional limitations. Thus, as a practical matter, for sake of ensuring reliability, it is unlikely that the gun would be utilized more than 100 times or so before a complete redressing of the assembly. The end result is a gun of significantly intentional limited capabilities that is still going to require a workover at some point.

With these gun limitations in mind, other efforts have been undertaken to help address the issue of gun shock. For example, certain shock absorber-like tools have been developed for incorporation into the gun assembly. Thus, in theory, the gun may be larger or of more flexible dimensions to allow for greater explosive energy during perforating, yet with gun shock mitigated by the shock absorber tool.

Unfortunately, shock absorber tools may be constructed of internal metal coils or springs that are unlikely to remain reliably effective after a single firing of the gun. As a result, redress of the assembly is required after every perforating application. That is, instead of being unable to reuse the assembly due to damaged electronics, reusability is now compromised due to the need to replace a shock absorber. Similarly, efforts have been undertaken to anchor the gun to the well casing during perforating to minimize assembly damage. However, this is likely to lead to casing damage. Once again, a degree of assembly damage of one type is likely to be exchanged for damage to another equipment feature. All in all, the operator is ultimately left with the undesirable option of deciding whether to compromise such equipment features or to use a smaller gun and compromise perforating application options.

SUMMARY

A shock mitigator is provided that may be beneficial for use in downhole perforating applications. The mitigator includes separate members adjacent one another with a plurality of shock mitigating implements at an interface therebetween. That is, the implements may serve to secure the members together. Additionally, a line such as a telemetric or power supply line may be routed through the interface along a recess that is provided into a surface of at least one of the members.

DETAILED DESCRIPTION

Embodiments are described with reference to certain downhole line conveyance applications. In particular, a wireline perforating application in a vertical well is shown. However, other forms of downhole shock inducing applications may take advantage of shock mitigating embodiments described herein. For example, wireline perforating applications that utilize tractoring equipment through deviated well sections may benefit from such a shock mitigator. Regardless, so long as the shock mitigatior is of a type utilizing adjacent members, a line may traverse a recessed interface therebetween such that power and/or communication may extend therebeyond, for example, to the perforating gun of the assembly.

Figure 1:
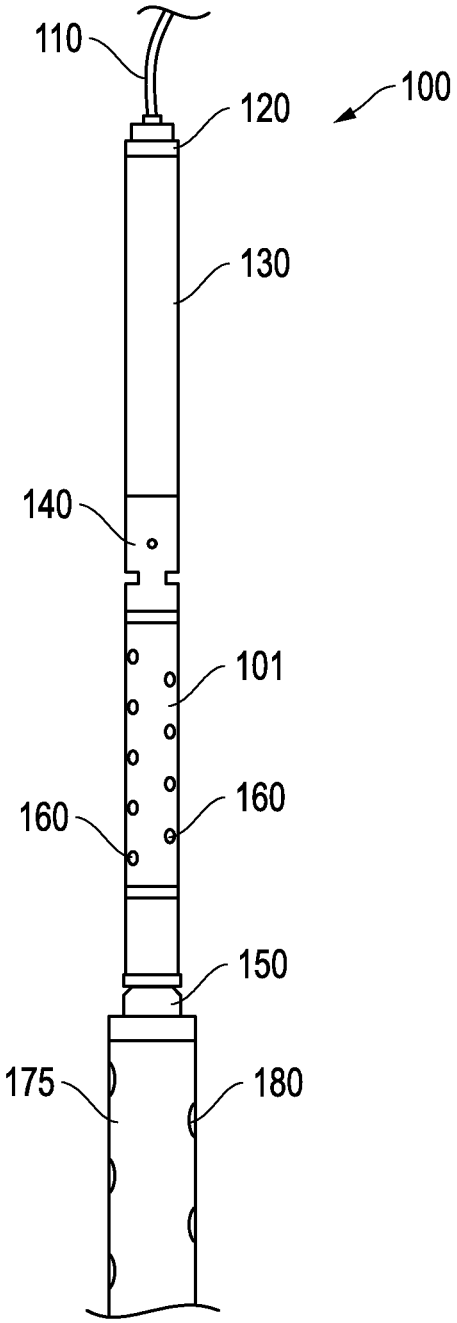
FIG. 1 is a side view of a perforating gun assembly with an embodiment of a shock mitigator incorporated therein.

Referring now to FIG. 1, a side view of a perforating gun assembly 100 is shown with an embodiment of a shock mitigator 101 incorporated therein. In the embodiment shown, the mitigator 101 is located between a perforating gun 175 and a housing 130 for shock sensitive components such as electronics. So, for example, where the firing of the gun 175 may induce several g's of force, the shock thereof is largely attenuated by the mitigator 101 before reaching the more sensitive electronics of the housing 130. For example, a host of instrumentation, gauges and other devices associated with downhole applications may be secured at the housing 130. Indeed, protecting sensitive devices such as centralizers, processors, motor or telemetry tools, etc. may be achieved in this manner, irrespective of their electronic nature.

As detailed further below, the shock mitigator 101 may absorb up to half or more of the bi-directional shock-related energy from the gun 175 (i.e. whether tensile or compressive). Thus, the gun 175 itself may be of greater size, emitting greater energy, yet with less damaging shock related effects on tools and components located at the housing 130 or any other location opposite the mitigator 101 relative the gun 175.

In the embodiment shown, the gun 175 may exceed about 2.5-3 inches in outer diameter. Specifically, the gun 175 may be a 3⅜ inch outer diameter gun. Further, the gun 175 may span over 9 feet in length. However, other even larger (or smaller) gun types may be utilized in conjunction with the mitigator 101. Further, the mitigator 101 is constructed with a plurality of shock mitigating implements 160 that extend into a body thereof. Yet, with added reference to FIGS. 2A and 2B, the implements 160 are positioned such that a line 201 may nevertheless traverse the mitigator 101 and reach the gun 175. So, for example, where the gun 175 includes a head 150 with capacity for electronic triggering of perforating through ports 180, the intervening mitagator 101 does not present an obstacle to the line 201 reaching the depicted head 150 (again see FIGS. 2A-2B).

In one embodiment, the shock mitigator 101 is 20-30 inches in length with an outer diameter of between about 1-2 inches. Further, it may be rated to effectively operate at pressures of up to between about 10,000-20,000 PSI and temperatures of 300-400° F. Of course, in other embodiments, a host of different dimensions and architecture may be employed for the mitigator 101, depending on the type of gun 175 and total energy of the perforating application.

Continuing with reference to FIG. 1, a crossover adapter 140 may be provided for coupling of the mitigator 101 to the electronic housing 130 or other portions of the overall assembly 100. In the embodiment shown, the adapter 140 is configured with an intentional weakpoint. However, due to the mitigator 101 the possibility of unintentional weakpoint breakage as a result of gun shock is minimized. Rather, the weakpoint may be intentionally broken through conventional techniques such as in response to the assembly 100 becoming stuck downhole.

Deploying the assembly 100, triggering a perforating application or even breaking a weakpoint as noted above may be directed through a conventional wireline cable 110. Of course, in other embodiments the cable 110 may be slickline or other suitable form of conveyance. Similarly, other non-perforating shock-inducing applications, such as mechanical packer or plug setting, may be carried out by tools below the shock mitigator 101. Regardless, as shown in FIG. 1, the cable 110 is coupled to cable head 120 where it is integrated with the electronics housing 130. Thus, wire leads, fiber optics or any other power or telemetry may ultimately reach, and extend beyond, the shock mitigator 101 as described above. Specifically, at least one line 201 may emerge beyond the mitigator 101 as detailed further below.

Figure 2A:
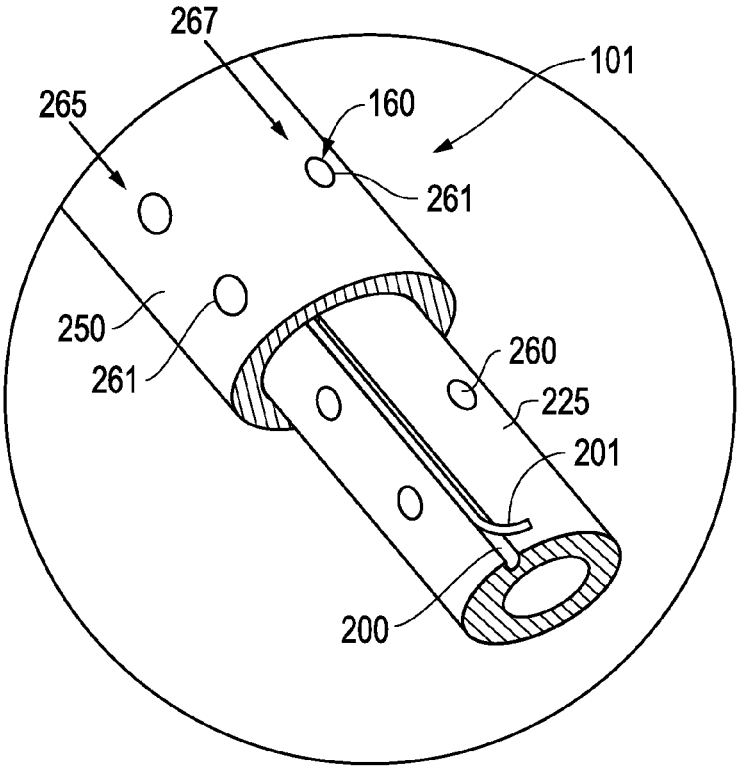
FIG. 2A is a partially exploded sectional view of the shock mitigator of FIG. 1 with recess for accommodating a line therein.
Figure 2B:
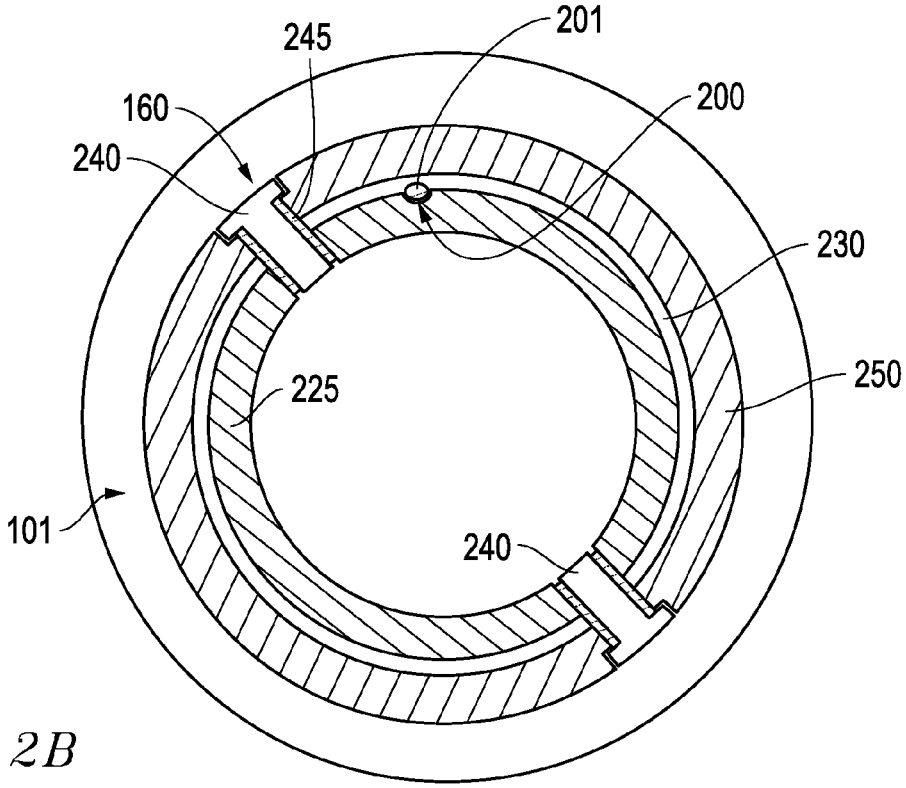
FIG. 2B is a front sectional view of the shock mitigator of FIG. 2A revealing an offset nature of shock mitigating implements to accommodate the recess.

Referring now to FIGS. 2A and 2B different sectional views of the shock mitigator 101 of FIG. 1 are depicted. Specifically, FIG. 2A is a partially exploded sectional view of the shock mitigator 101 with a recess 200 for accommodating the above noted line 201 therein. FIG. 2B on the other hand is a front sectional view of the mitigator 101 of FIG. 2A revealing an offset nature of shock mitigating implements 160 so as to readily accommodate the recess 200.

With reference to FIG. 2A, the shock mitigator 101 is made up of two separate interfacing members 225, 250. In the specific embodiment shown, inner 225 and outer 250 cylindrical members are utilized with one 225 configured to rest internal of the other 250. However, other architectural forms and/or alternate types of interfacing may be employed. Regardless, with brief added reference to FIG. 2B, an interface 230 is present between the members 225, 250. Nevertheless, the members 225, 250 are held together by a plurality of shock mitigating implements 160 as alluded to hereinabove.

In the embodiment shown, each shock mitigating implement 160 is provided through orifices 260, 261 of each member 225, 250. Further, each implement 160 may be of a shock responsive construction. For example, in the embodiment shown, each implement 160 may include an elastomeric tubing 245, perhaps of 10-15 durometer hardness with a bolt 240 therethrough. Specifically, the tubing 245 may be a conventional synthetic rubber. Thus, the members 225, 250 may be reliably held together with shock-responsive attenuation through the implements 160. As a practical matter, such architecture may encourage propagation of mechanical impulses through the shock mitigator 101 with an overall z-axis acceleration from gun shots reduced by as much as half.

Continuing with reference to FIG. 2A, the locations of the implements 160 are arranged such that a substantially linear, uninterrupted and implement-free corridor is provided where a recess 200 into one of the members 225 is provided so as to accommodate the above referenced line 201. In the embodiment shown, the linear recess 200 is provided in the outer surface of the inner member 225. However, in other embodiments, the recess 200 may be at the inner surface of the outer member 250. Indeed, the recess 200 may even be defined by both members 225, 250 having a partial recess into corresponding surfaces aligned at the interface 230 (see FIG. 2B). The particular construction selected for the recess 200 may be a matter of manufacturability. In this regard, a conventional grease may be used at the recess 200 and/or the interface 230.

As shown in FIG. 2B, the noted interface 230 between the members 225, 250 is readily visible. However, in certain embodiments the amount of space between the members 225, 250 may be more negligible in appearance. Nevertheless, the interface 230 in combination with the shock mitigating implements 160 may be sufficient to provide the degree of shock attenuation as described above.

Additionally, in the view of FIG. 2B, the offset nature of the implements 160 may be more apparent. For example, at the particular cross-section of the mitigator 101 that is shown, one implement 160 is shown slightly to the left of the recess 200 and line 201. This is consistent with the row 265 of implements 160 to the left of the recess 200 and line 201 of FIG. 2A. Similarly, a row 267 of implements to the right of the recess 200 and line 201 are also depicted in FIG. 2A such that the noted uninterrupted corridor is provided for the recess 200 and line 201. As a result, a practical manner of manufacture is provided that does not require winding about a variety of implement locations 160 in order to provide an electric power or telemetric line 201 through the mitigator 101.

Figure 3:
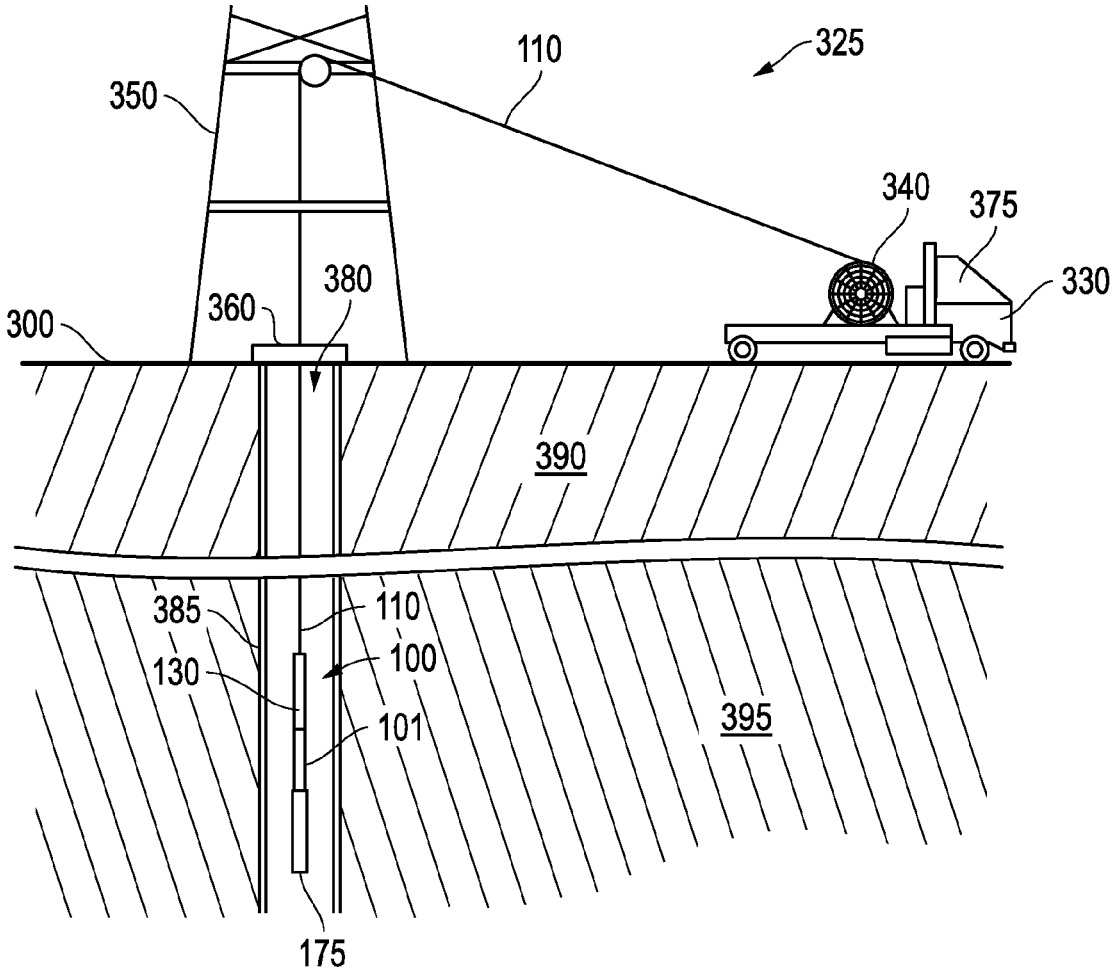
FIG. 3 is an overview of an oilfield with a well accommodating the gun assembly and mitigator of FIG. 1 therein.

Referring now to FIG. 3, an overview of an oilfield 300 is shown with a well 380 traversing various formation layers 390, 395. The well 380 also accommodates the gun assembly 100 with shock mitigator 101 as detailed hereinabove. Specifically, a perforating gun 175 and electronics housing 130 are shown separated by the mitgator 101. Thus, shock resulting from use of the gun 175 to perforate the casing 385 that defines the well 380 may be 'mitigated' to a degree. As a result, some of the more sensitive components of the electronics housing 130 may remain unharmed by the perforating application.

In the embodiment of FIG. 3, the well 380 is vertical and the assembly 100 lowered thereinto via conventional wireline 110. However, in other embodiments, the well 380 may be deviated and assembly features such as tractoring tools may be incorporated into the assembly 100. Nevertheless, in such circumstances, these types of tools may also be safeguarded by positioning of the shock mitigator 101 between such tools and the gun 175. Further, in the embodiment shown, a wireline perforating application is run by deploying the assembly 100 via conventional wireline equipment 325. Specifically, a mobile truck 330 with reel 340 is provided to the oilfield 300 where a rig 350 is available for supporting conveyance of the wireline 110 and assembly 100 past a well head 360 and into the well.

FIG. 3 also reveals a control unit 375 at the truck 330 for directing the perforating application. For example, power and/or communications between the surface and the assembly 100 may help monitor and direct the application. Specifically, gauges, monitors or actuators of the electronics housing 130 may communicate with the control unit 375 during an application. Further, the architecture of the shock mitigator 101 also allows for such power, telemetry or communications to take place between the gun 175 and the control unit 375 as detailed hereinabove. So, for example, real-time triggering and other interfacing between the surface and the gun 175 may be available to an operator during and throughout the application.

Figure 4:
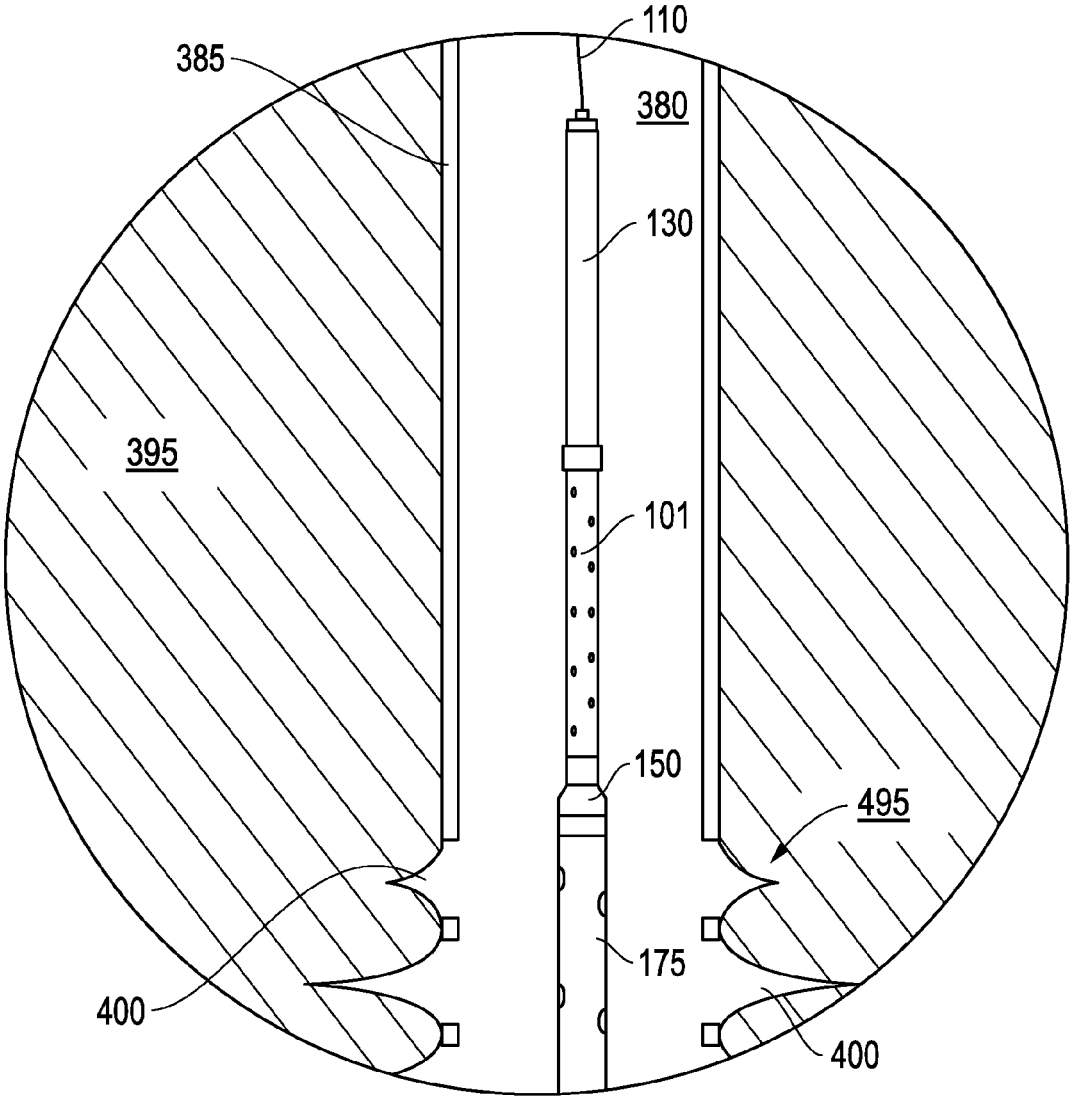
FIG. 4 is an enlarged view of the assembly of FIG. 3 during a perforating application.

Referring now to FIG. 4, an enlarged view of the assembly 100 of FIG. 3 is shown during a perforating application. More specifically, with the gun 175 positioned at a production region 495 of the formation 395, it may be triggered to form perforations 400 as shown. As indicated above, this triggering may be achieved by way of a signal from surface over a line 201 that reaches all the way to the gun 175 or head 150 thereof (see FIGS. 2A and 2B). That is, the intervening shock mitigator 101 does not serve as an impediment to such real-time signal and/or power capacity between the surface and the gun 175. Thus, effective, more tightly regulated perforations 400 through the casing 385 may be formed via direct surface control.

Continuing with reference to FIG. 4, with added reference to FIGS. 2A and 2B, the shock mitigator 101 is constructed in a manner that readily accommodates a communication line 201 therethrough as indicated above. Furthermore, the mitigator 101 may be sized and tailored in light of the gun 175 or other shock inducing tool to be utilized. For example, as indicated above, the mitigator 101 may be architecturally tailored to accommodate a gun 175 exceeding about 9 feet in length and 3 inches in diameter while reducing shock reaching the electronics housing 130 by about half.

Figure 5:
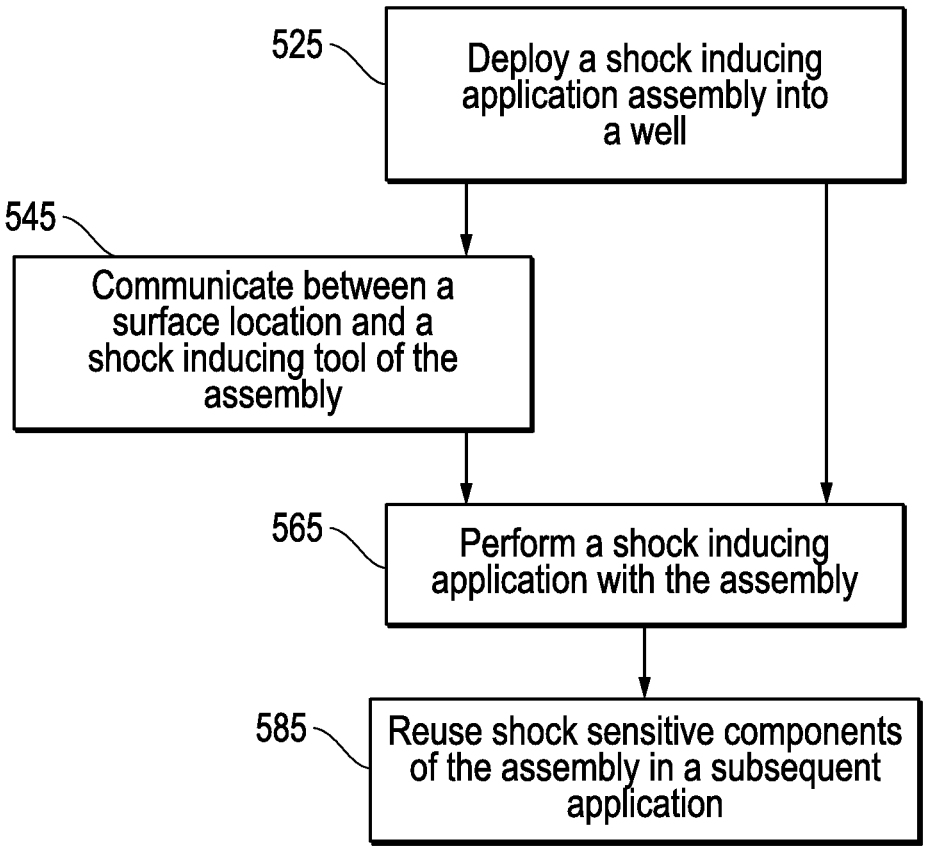
FIG. 5 is a flow-chart summarizing an embodiment of employing a gun assembly with shock mitigator for a perforating application in a well.

Referring now to FIG. 5, a flow-chart is depicted summarizing an embodiment of employing a shock inducing assembly with a mitigator as detailed herein. The assembly may be a perforating gun assembly as detailed herein. Although, a plug setting or other high g-force application assembly may also benefit from the mitigator and techniques described. Regardless, as indicated at 525, the assembly is deployed into the well and at the same time, power and/or data communication between the shock inducing tool of the assembly may be maintained as indicated at 545. As detailed hereinabove, this is a result of an uninterrupted recess or channel through an interface of the mitigator that may be used to accommodate a communication line.

In one embodiment, the communication line may traverse the mitigator but not necessarily reach the surface, for example, where the line is run only between a particular instrument of the housing 130 and the gun 175 of FIG. 4. Whatever the case, such tools or instrumentation of the housing 130 or other location at the opposite side of the mitigator relative the shock inducing tool are substantially safeguarded. Indeed, as indicated at 565, the shock inducing application may take place and yet, as indicated at 585, these shock sensitive components may be reliably re-used.

Embodiments described hereinabove include a shock mitigator that may be repeatably utilized without undue concern over replacing or refurbishing mitigator parts after every use of the associated perforating gun assembly. Thus, larger guns and more flexible perforating application parameters may be utilized without concern over damage to other associated electronic equipment as well. In fact, the shock mitigator is configured in such a manner as to accommodate a line for electronic and/or telemetric capacity therethrough. That is, not only is damage to nearby electronics substantially avoided, but the gun itself may even be communicatively responsive regardless of the intervening mitigator. Therefore, flexibility in terms of perforating application parameters may be further enhanced.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A system comprising:

a shock mitigator comprising:

a first member, a second member adjacent said first member, a plurality of shock mitigating implements in offset rows and disposed at an interface between said members and securing said members together;

a line traversing the interface between the rows and-along a linear recess into a surface of at least one of said members, the recess occupying an implement-free uninterrupted corridor defined by the offset of the rows; and an electronics housing coupled to the shock mitigator by a crossover adapter configured with an intentional weak point to allow separation of the electronics housing from the shock mitigator.

2. The mitigator of claim 1 wherein the line is one of an electrical line and a fiber optic line.

3. The mitigator of claim 1 wherein at least one of said plurality of shock mitigating implements comprises:

a bolt; and elastomeric tubing about said bolt for contacting each of said members.

4. The mitigator of claim 3 wherein said elastomeric tubing is a synthetic rubber.

5. The mitigator of claim 1 wherein said members are of a length of between about 20 inches and about 30 inches.

6. The mitigator of claim 1 wherein said first member is an outer cylindrical member and said second member is an inner cylindrical member disposed within said outer cylindrical member with the interface therebetween.

7. The mitigator of claim 6 wherein said outer cylindrical member is between about 1 and about 2 inches in outer diameter.

8. A shock inducing application assembly comprising:

a shock sensitive component housing;

a shock inducing tool;

a shock mitigator disposed between and coupled to each of said housing and said tool, said mitigator comprising adjacent members with an interface therebetween to accommodate a linear communication line therethrough and a plurality of shock mitigating implements securing the members together, the line disposed in an implement-free recess at the interface between adjacent rows of the implements; and a crossover adapter connecting the shock sensitive component housing to the shock mitigator and being configured with an intentional weak point to allow separation of the housing from the shock mitigator.

9. The assembly of claim 8 wherein said shock inducing tool is one of a perforating gun and a plug setting tool.

10. The assembly of claim 9 wherein the perforating gun exceeds about 2.5 inches in outer diameter.

11. The assembly of claim 9 wherein the perforating gun exceeds about 9 feet in length.

12. The assembly of claim 8 wherein a component of said housing is selected from a group consisting of instrumentation, gauges, electronics, a processor, a monitor, an actuator, a centralizing tool, a telemetry tool and a motor tool.

13. The assembly of claim 8 further comprising a downhole line for deployment thereof into a well.

14. The assembly of claim 13 wherein said downhole line is one of a wireline cable and slickline.

15. The assembly of claim 13 wherein said downhole line is communicatively coupled to equipment at a surface of an oilfield accommodating the well and to said shock inducing tool through the communication line.

16. A method of performing a shock inducing application in a well, the method comprising:

deploying a shock inducing tool of an assembly into the well;

communicating from equipment at an oilfield surface accommodating the well to the tool;

carrying out the shock inducing application;

absorbing shock-related energy of the application with a plurality of shock absorber members having offset adjacent rows of shock mitigating implements at an interface between the members, wherein the communicating is accomplished at least partially through a linear communication line at an implement-free recess located at the interface; and breaking the assembly at a weakpoint within a crossover adapter connecting the plurality of shock absorber members to the shock sensitive components of the assembly after said carrying out of the applications;

retrieving the shock sensitive components for use in a subsequent shock inducing application.

17. The method of claim 16 wherein the application is one of a perforating application and a plug setting tool application.

* * * * *